US008651191B2

(12) United States Patent
Wilson

(10) Patent No.: US 8,651,191 B2
(45) Date of Patent: Feb. 18, 2014

(54) SLIM HOLE PRODUCTION SYSTEM AND METHOD

(75) Inventor: Dennis R. Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 12/895,046

(22) Filed: Sep. 30, 2010

(65) Prior Publication Data

US 2011/0073317 A1 Mar. 31, 2011

Related U.S. Application Data

(60) Provisional application No. 61/247,313, filed on Sep. 30, 2009, provisional application No. 61/247,386, filed on Sep. 30, 2009, provisional application No. 61/247,331, filed on Sep. 30, 2009.

(51) Int. Cl.
*E21B 43/00* (2006.01)

(52) U.S. Cl.
USPC ..... 166/369; 166/372; 166/105; 166/107; 417/555.2

(58) Field of Classification Search
USPC ..... 166/105, 107, 372, 109, 68, 369; 417/547, 555.2
See application file for complete search history.

(56) References Cited

U.S. PATENT DOCUMENTS 3,074,352 A 1/1963 Vincent
4,013,387 A * 3/1977 Gage ..... 417/554
4,089,626 A * 5/1978 Hill et al. ..... 417/431
4,358,248 A * 11/1982 Bodine ..... 417/53
4,666,375 A * 5/1987 Kime ..... 417/46
4,787,455 A * 11/1988 Snavely et al. ..... 166/279
5,031,402 A * 7/1991 Klaeger ..... 60/369
5,083,613 A * 1/1992 Gregoli et al. ..... 166/275
5,382,142 A * 1/1995 Spears ..... 417/445
6,142,224 A * 11/2000 Stuebinger et al. ..... 166/105.5
6,186,238 B1 * 2/2001 Tornquist ..... 166/369
6,263,965 B1 * 7/2001 Schmidt et al. ..... 166/272.3
6,371,206 B1 * 4/2002 Mills ..... 166/311
6,457,522 B1 * 10/2002 Bangash et al. ..... 166/267
6,543,542 B2 * 4/2003 Tieben ..... 166/369
6,543,543 B2 * 4/2003 Muth ..... 166/370
7,108,059 B1 * 9/2006 Lanier ..... 166/105
7,117,947 B2 * 10/2006 Wilson ..... 166/372
7,541,315 B2 * 6/2009 Jennings ..... 507/90
2003/0037929 A1 * 2/2003 Leniek, Sr. ..... 166/369
2005/0226752 A1 10/2005 Brown
2006/0002808 A1 * 1/2006 Williams ..... 417/555.1
2006/0011345 A1 * 1/2006 Delaloye et al. ..... 166/304

(Continued)

OTHER PUBLICATIONS

Slim hole well. (n.). Schlumberger Oilfield Glossary. Retrieved Dec. 10, 2012, from Schlumberger website: http://glossary.oilfield.slb.com/search.cfm.*

*Primary Examiner* — Giovanna Wright
*Assistant Examiner* — Robert E Fuller
(74) *Attorney, Agent, or Firm* — ConocoPhillips Company

(57) ABSTRACT

A slim hole production system for pumping liquids to the surface of a hydrocarbon well and especially a hydrocarbon well that is producing both natural gas and liquids where the diameter of the hole in the production area is too small to get production tubing and a sucker rod into a productive arrangement. The slim hole pump includes a hollow tube that raises and lowers the plunger and carries the liquids to the surface and uses the annulus to produce the gas.

11 Claims, 3 Drawing Sheets

(56) References Cited

U.S. PATENT DOCUMENTS

| | | | | |
|---|---|---|---|---|
| 2006/0169458 | A1* | 8/2006 | Jones | 166/369 |
| 2006/0271299 | A1* | 11/2006 | Ward et al. | 702/6 |
| 2006/0278398 | A1* | 12/2006 | Ruggeri et al. | 166/369 |
| 2007/0158062 | A1* | 7/2007 | Heller et al. | 166/69 |
| 2007/0253848 | A1* | 11/2007 | Lea | 417/437 |
| 2008/0002954 | A1* | 1/2008 | Carr | 392/478 |
| 2008/0164034 | A1* | 7/2008 | Uttley | 166/372 |
| 2008/0190622 | A1* | 8/2008 | Johnson et al. | 166/372 |
| 2009/0196779 | A1* | 8/2009 | Weaver et al. | 417/552 |
| 2011/0073317 | A1* | 3/2011 | Wilson | 166/369 |
| 2011/0073318 | A1* | 3/2011 | Wilson | 166/372 |

* cited by examiner

SLIM HOLE PRODUCTION SYSTEM AND METHOD

CROSS-REFERENCE TO RELATED APPLICATIONS

This application is a non-provisional application which claims benefit under 35 USC §119(e) to U.S. Provisional Application Ser. No. 61/247,313 filed Sep. 30, 2009, entitled "Slim Hole Production System," and to U.S. Provisional Application Ser. No. 61/247,386 filed Sep. 30, 2009, entitled "Producing Gas and Liquid from Below a Permanent Packer in a Hydrocarbon Well," and also to U.S. Provisional Application Ser. No. 61/247,331 filed Sep. 30, 2009, entitled "Double String Pump for Hydrocarbon Wells," all of which are incorporated herein in their entirety.

STATEMENT REGARDING FEDERALLY SPONSORED RESEARCH OR DEVELOPMENT

None.

FIELD OF THE INVENTION

This invention relates to pumping liquids from hydrocarbon wells that are producing natural gas.

BACKGROUND OF THE INVENTION

The process of drilling hydrocarbon wells results in many wells with small diameter tubing or casing in the hydrocarbon bearing zone due to problems encountered during drilling and more casing strings being installed than were originally anticipated. Each string of casing is inherently smaller in diameter than the previously installed string to allow the successive casing string to be installed through the previous casing strings. For whatever the reason, many wellbores exist with casing in the hydrocarbon bearing zone with a diameter of less than three inches. When these wells are producing some amount of gas, the flow rate is sufficient to entrain and carry the liquids with the gas to the surface. Eventually, these slim holes mature to the point that the gas flow rate is not sufficient to carry the liquids to the surface. At the same time, there is still enough gas in the formation to continue to provide an economic incentive to keep the well open and producing.

Typically, some have installed coiled tubing that has a much smaller diameter than the small diameter casing to use the same gas productivity in the well to flow upwardly at a faster rate and keep the liquids entrained with the gas. This may work for a while, but the productivity of gas wells eventually diminishes to a point where it must be shut in.

In an ideal world, production tubing would be installed and a rod pump installed to positively pump the liquids from the bottom of the well and allow gas production to continue for the longest potential time and greatest potential recovery. However, many slim holes are not large enough to accommodate production tubing in which a rod pump can operate.

SUMMARY OF THE INVENTION

The invention more particularly includes a system for producing liquids and solids from the bottom of a slim hole natural gas well where the system comprises a string of casing installed in a wellbore where a lower end of the casing string is near the bottom of the wellbore and a pump including a barrel and a plunger is inserted into the casing string such that the barrel is secured to the casing near the lower end of the casing string. A string of hollow rod is disposed within the casing string such that an annulus is formed around the hollow rod string within the casing and where the hollow rod string is connected to the plunger that is positioned within the barrel of the pump for movement up and down the barrel and liquids are produced to the surface from the plunger up through the hollow rod string.

In a preferred arrangement, check valves are placed at intervals in the hollow rod string equivalent to expected pumped volume per pump cycle to aid in transporting solids to surface. Solids and liquid will advance from one ball check to at least the next per pump cycle on low liquid volume wells.

In another aspect, the invention more particularly comprises a process for producing liquids and solids from the bottom of a cased slim hole natural gas well where the process includes installing a pump at the end of a string of hollow rod string where the pump includes a barrel and a hollow plunger and where the hollow plunger is connected to and in fluid communication with the hollow rod string. The plunger includes a traveling valve to admit liquids into the hollow interior of the plunger and the barrel is secured to the inside of the casing wherein an annulus is formed between the inside of the casing and the outside of the hollow rod string. The process further includes raising and lowering the plunger to draw liquids through the standing valve and through the traveling valve and eventually into the hollow rod string so that natural gas is produced through the annulus to the surface.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Turning now to the preferred arrangement for the present invention, reference is made to the drawings to enable a more clear understanding of the invention. However, it is to be understood that the inventive features and concept may be manifested in other arrangements and that the scope of the invention is not limited to the embodiments described or illustrated. The scope of the invention is intended only to be limited by the scope of the claims that follow.

A hydrocarbon well having an internal diameter in the hydrocarbon bearing zone of less than about 3 inches is generally described as a slim hole well. Many such slim hole wells have accessed rich hydrocarbon deposits and produce natural gas and recoverable liquids. Typically, these slim hole wells produce sufficient gas to entrain and carry most liquids that were produced from the formation to the surface due to the high gas flow rate. Both the liquids and gases are collected and if the liquids comprise hydrocarbons, they are taken to market. Typically the liquid by-product is water which is disposed of. As a slim hole well produces hydrocarbons over time, its flow rate gradually diminishes until liquids start accumulating at the bottom. High production rates may last many months or may last many years. However, gas rates inherently diminish as the reservoir is drained. As the gas rate diminishes, less of the liquid is carried with the gas flow to the surface such that a liquid volume at the bottom of the well is above the perforations that allow the hydrocarbons into the wellbore. Although gas may continue to bubble through the liquid, the diminishing production rate typically gets quite choked down to a substantially lower rate.

Figure 1:
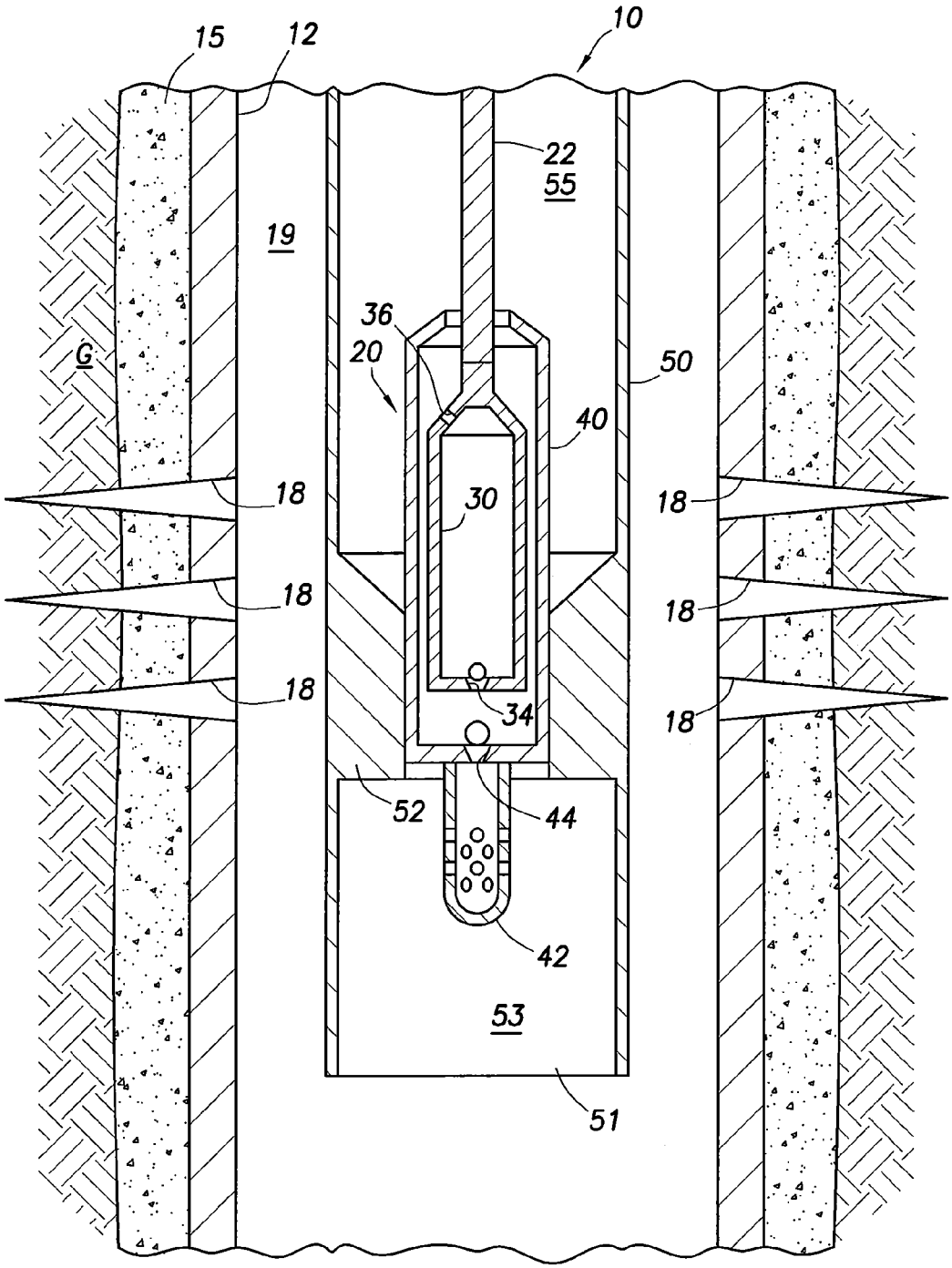
FIG. 1 (PRIOR ART)
FIG. 1 is a cross section of a conventional wellbore with rod pump installed to produce liquid from the bottom of the wellbore.

In a conventionally sized well, operators typically install a rod pump. For example, as shown in FIG. 1, a conventional wellbore, generally indicated by the arrow 10, is shown formed or drilled into the ground G. According to conventional procedures, casing 12 has been inserted into the wellbore and sealed against the wall of the wellbore with cement 15 whereafter perforations 18 have been punched through the casing 12 and through the cement 15 and into a hydrocarbon-bearing formation in the ground G by explosive charges. Hydrocarbons in the hydrocarbon-bearing formation are then enabled to flow into the wellbore 10 through perforations 18 where natural gas and other gases would ascend up the wellbore through annulus 19 while liquids accumulate at the bottom of the wellbore 10. The liquid level is drawn down by a production system including a pump, generally indicated by the arrow 20, which is associated with a production tubing 50. The pump 20 and production conduit 50 are run into wellbore 10 separately with the production conduit 50 being first inserted into the wellbore 10. The production tubing 50 is sufficiently smaller than the casing 12 so that gas is easily able to flow up to the surface through annulus 19. The production tubing 50 also has an open bottom end 51 preferably below the lowest of the perforations 18 and above the bottom of the wellbore 10. Production tubing further includes a segment 52, generally called a seating nipple, that includes an inside contour and dimension to receive barrel 40 and seal the barrel in place. Seating nipples typically have a shoulder stop or a reduction of the interior dimension also referred to as "ID", and a highly machined surface or polished bore for packing seals on barrel 30 to engage into. Thus, the barrel 40 is installed after the production conduit 50, but may be sealed in seating nipple 52 and therefore sealed and isolating the interior 55 of the production tubing 50 from the annulus 19 of casing 12. The production tubing 50 is therefore divided into a small segment at the bottom, called a quiet zone 53 and a production path 55 above the seating nipple 52.

The pump 20 includes a plunger 30 arranged to move up and down within the barrel 40. The plunger 30 is attached to the bottom end of a sucker rod string 22 and is able to move up and down within the barrel 40 that is firmly connected or locked into the seating nipple 52, but it should be understood that the periphery of the plunger 30 and the interior of the barrel 40 are each machined and sized so that any liquid flow around the plunger 30 is substantially restricted. The preferred path for liquids to travel through the barrel 40 is also through the interior of the plunger 30. Below the barrel 40 is a strainer nipple 42 having a number of holes to allow liquids or gas that is in the quiet zone 53 to pass into the barrel through stranding valve 44. Standing valve 44 is shown to be a ball and seat, but may be any suitable one-way valve technology. As the plunger 30 is lifted relative to the barrel 40, liquids are drawn up through the strainer nipple 42 and through standing valve 44 to fill the space in the barrel 40 below the plunger 30. The plunger 30 includes a travelling valve 34 that like the standing valve 44, is shown as a ball and seat, but may be any suitable one-way valve technology. As the plunger 30 is lowered in the barrel 40, standing valve 44 closes to keep liquid in the barrel but unseat the travelling valve so that the liquids in the barrel below the plunger 30 enter and flow into the plunger 30. Liquids that were already in the plunger 30 before the plunger began its downward movement in the barrel exit the top of the plunger 30 through one or more vent holes 36. Liquids that pass out of the vent holes 36 fill the production path 55 and are eventually delivered to the surface.

In a slim hole well, there simply is not room for a string of production tubing 50 to be installed that maintains annulus 19 for gas flow while accommodating a barrel and plunger inside the production tubing.

Figure 2:
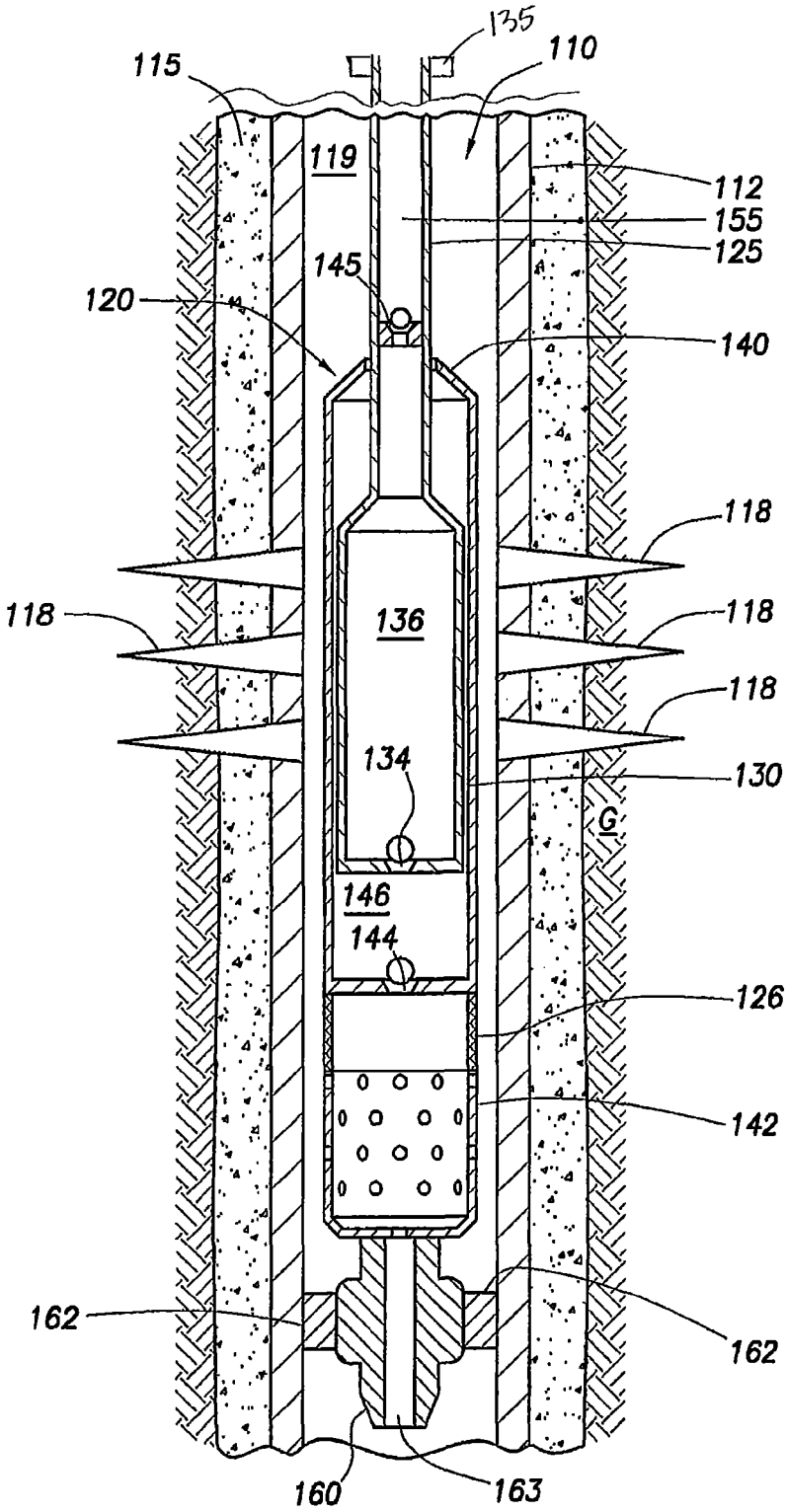
FIG. 2 is a cross section of a slim hole wellbore with hollow rod pump of the present invention installed to produce the liquids and allow continuous production of the natural gas.

A solution for producing liquids at the bottom of slim hole wellbores is shown in FIG. 2 where like elements are presented with the same reference numbers used in FIG. 1, but are identified with reference numbers that are three digit reference numbers with the first digit being "1" where the corresponding element in FIG. 1 has a two digit reference number. What should be seen as different about the invention as compared to the conventional arrangement is that the pump 120 is connected to hollow rod string 125 and arranged to pump the liquid up the axis of the hollow rod string. Secondly, there is no production tubing equivalent to production tubing 50 in FIG. 1. The barrel includes a perforated nipple 142 with a pipe lock 160 attached to the bottom or distal end of the perforated nipple 142. Pipe lock 160 includes dogs 162 that are deployed radially outwardly to lock into the casing 112 and hold the pipe lock 160, perforated nipple 142 and barrel 140 in position near the bottom of the wellbore 110. The perforated nipple 142 is attached to the barrel 140 by a hollow shear tool 126 that will be more fully described in reference to FIG. 3, below. As natural gas continues to be produced from the formation through perforations 118, the gas is allowed to rise up through annulus 119 outside of the hollow rod string 125. Liquids that are produced descend from the perforations 118 and are drawn through holes in the perforated nipple 142 as the plunger 130 is lifted upwardly in the fixed barrel 140. The liquid is drawn through standing valve 144 which is a one-way check valve of any suitable form to allow flow up into barrel 140, but not down into the perforated nipple 142. When plunger 130 descends in barrel 140, standing valve 144 seats or closes and travelling valve 134 opens to allow the liquids in the working space 146 of the barrel 140 to enter into the plunger cavity 136. Liquids in the plunger cavity 136 are pressed up through check valve 145 and into production path 155 inside the hollow rod string 125.

Space in a slim hole is limited and liquid flow into the perforated nipple 142 may enter radially and may enter axially through core 163 of pipe lock 160. The dogs 162 are spaced around the pipe lock 160 to generally center the barrel 140 and perforated nipple 142 and allow flow from below the pipe lock 160 to the perforated nipple 142 between the dogs. Typically three or four dogs 162 are used to hold the pipe lock 160 in position with respect to the casing 112.

One aspect of the present invention is that it is preferred that any solids such as sand or other particles are produced with the liquid. The small diameter of the hollow rod string 125 along with check valves spaced apart up the length of the rod string 125 to the surface entrain the solids with the liquid by high flow rate and when the pump 120 ends a pump cycle, each of the check valves 145 keep such solids from descending all the way to the plunger 136. In other words, each stroke of the plunger 130 may move the same volume of liquid, but the liquid moves far closer to the surface at a higher velocity so that the entrained solids are more likely to be carried farther up the production path 155 within the hollow rod string 125 during each pump operation cycle. Moreover, check valves such as shown at 145 are provided within the production path 155 so that when a pumping cycle is ended and the pump 20 is idled, the particles only settle down to the last check valve each particle may have passed. Ideally, by calculating the wellbore volume that liquid will be allowed to occupy and by spacing the check valves or ball checks within the string so that the volume between them does not exceed a pumping cycle volume then each operating cycle would cause the particles to pass through at least one check valve. Again, with the smaller diameter in the production path 155, a pump rate can set at or above the lift velocity required for the well and re-entrainment of the solids into the liquid flow should be quicker and more certain.

In one further preferred aspect, a rod rotator may be installed at the top of the well near the location where the lifting mechanism attaches to the rod string 125. The rod rotator 135 rotates the hollow rod string 125 and spreads any wear from the up and down motion evenly around the outside of the rod string 125 to extend the life of the rod string 125. Also, with the rod string 125 being hollow, it will likely and preferably have a larger diameter than equivalent non-hollow sucker rod of the same strength and will therefore have a larger radius distributing any load on the inside of the casing 112 in a manner that will reduce the cutting or damaging wear on the casing 112.

It should further be understood that while the plunger 130 is shown with outside walls spaced from the inside surfaces of the barrel 140, the adjacent surfaces of the outside of the plunger 130 and inside of barrel 140 are machined with close tolerances to prevent liquids from passing through the gap. As noted above, a series of check valves, such as check valve 145 are placed at intervals up the hollow rod string equivalent to expected pumped volume per pump cycle to aid in transporting solids to surface. Solids and liquids are arranged to advance from one check valve 145 to at least the next check valve 145 per pump cycle on low liquid volume wells.

Figure 3:
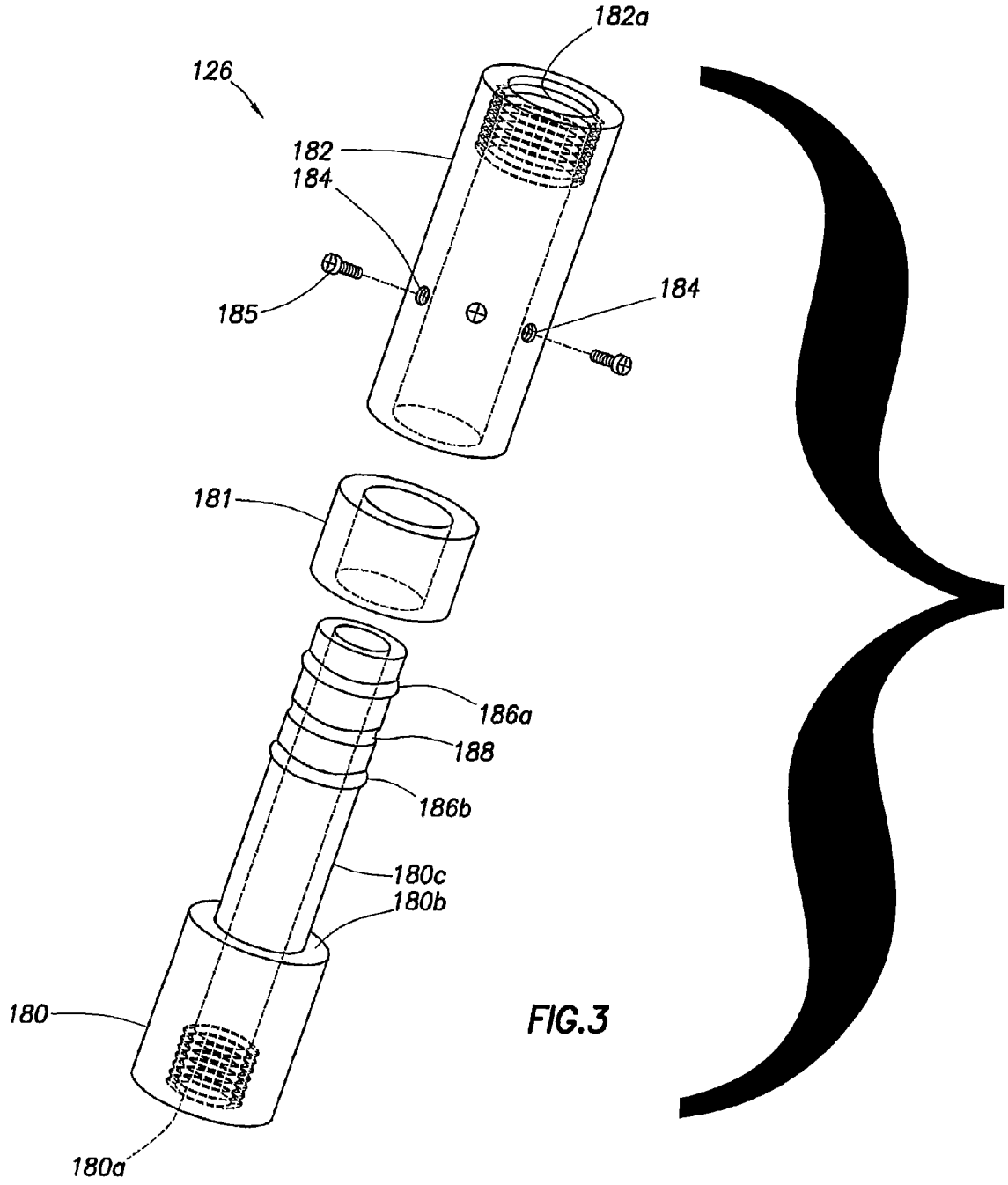
FIG. 3 is an exploded perspective view of a hollow shear tool for providing preferred breakaway for the production system of the present invention.

Turning now to FIG. 3, one particular aspect of the invention it to provide a well operator a way to most easily get back into the wellbore 110 in the event that the pump 120 needs to be withdrawn and the pipe lock 160 is corroded into the casing 112. A hollow shear tool 126 provides a "weakest link" in the production system so that most of the string is recovered and that other tools may be used to recover only a small portion of the string nearest the most likely to be stuck element and that being the pipe lock 160. The arrangement and operation of the hollow shear tool 126 will now be explained. The hollow shear tool 126 comprises three segments. Base segment 180 includes screw threads 180*a* to attach to the perforated nipple 142 with ring segment 181 overlying the upper, smaller diameter portion 180*c* of base segment 180. The ring segment slides down smaller diameter portion 180*c* until it contacts shoulder 180*b*. Breakaway segment 182 also slides over smaller the diameter portion 180*c* until holes 184 generally align with groove 188 in smaller diameter portion 180*c*. Breakaway segment 182, like base segment 180 includes screw threads that are arranged to attach to the hollow rod string plunger 140. O-rings 186*a* and 186*b* are provided to seal the hollow interior passageway from the outside of hollow shear tool 126. With a preselected number of screws screwed into holes 184 and into groove 188, a predetermined breakaway strength can be provided so that when a tension between the barrel 140 and perforated nipple 142 exceeds the predetermined breakaway strength, the breakaway portion 182 will separate from the base portion. The predetermined breakaway strength may be easily tested using conventional machine shop stools such as a press and pressure gauge by removing ring segment 181 and inserting a number of screws 185 and applying compression force until the screws break. The screws 185, in the arrangement of the hollow shear tool, should provide the same breakaway strength in compression and tension. The inventor expects that breakaway strengths of roughly 10,000 pounds or 15,000 pounds may be achieved and using stronger or weaker materials would expand the capacity range of such an arrangement. Clearly, the ease at which the breakaway strength may be successively measured should provide confidence in the actual breakaway strength. Screw holes that are not used are preferably blinded off to reduce the possibility of leaking.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A system for producing liquids and particles from the bottom of a slim hole natural gas well where the system comprises:

a) a string of casing installed in a wellbore in the slim hole where a lower end thereof is near the bottom of the wellbore;

b) a pump comprising a barrel and a plunger wherein the barrel is secured to the casing near the lower end thereof;

c) a string of hollow rod disposed within said casing such that an annulus is formed around the hollow rod string within the casing and where the hollow rod string is connected to the plunger that is positioned within the barrel of the pump for movement up and down the barrel and liquids and particles are produced to the surface from the plunger up through the hollow rod string, wherein the string of hollow rod further includes at least two check valves spaced apart within the hollow rod string above the plunger to prevent particles that might settle in the liquids from descending below each check valve and maintaining the particles at a level in the wellbore closer to the surface so that when the pump is operating, the particles are pushed closer and closer to the surface to eventually be fully removed from the well, wherein the liquids flow through the interior of the plunger, and d) a hollow shear tool attached to the barrel to allow the pump to be withdrawn from the well.

2. The system according to claim 1 wherein gas is produced to the surface through said annulus.

3. The system according to claim 2 wherein the system includes no more than two flow paths up and down said casing where one flow path is the annulus and the other is through the hollow rod string.

4. The system according to claim 1 further including a rod rotator to rotate the string of hollow rod so that the string of hollow rod does not wear on one single side as it moves up and down the well but the rod rotator is distributing wear evenly around the outside of the hollow rod.

5. The system according to claim 1, wherein the hollow shear tool includes a base segment, a ring segment and a breakaway segment.

6. The system according to claim 1, wherein a perforated nipple is attached to the hollow shear tool.

7. A process for producing liquids and particles from the bottom of a cased slim hole natural gas well where the process comprises:

a) installing a pump at the end of a string of hollow rod string in the slim hole where the pump includes a barrel and a hollow plunger and where the hollow plunger is connected to and in fluid communication with the hollow rod string in the slim hole and further includes a traveling valve to admit liquids into the hollow interior of the plunger and wherein the barrel is secured to the inside of the casing wherein an annulus is formed between the inside of the casing and the outside of the hollow rod string;

b) periodically raising and lowering the plunger to draw fluids through a standing valve and through the traveling valve and eventually into the hollow rod string;

c) preventing particles from flowing and settling back down within the hollow rod string on the pump by providing at least two check valves along the length of the hollow rod string so that solids and fluid will advance from the first check valve to the next during successive pump cycles, even on low fluid volume wells whereby the particles may not descend in the hollow rod string below each check valve; and d) producing natural gas through the annulus to the surface, wherein a hollow shear tool is attached to the barrel to allow the pump to be withdrawn from the well.

8. The process according to claim 7 further comprising the step of attaching the barrel to the casing once the barrel is lowered into position in the well.

9. The process according to claim 7 further including the step of rotating the string of hollow rod so that the string of hollow rod does not wear on one single side as it moves up and down the well but a rod rotator is distributing wear evenly around the outside of the hollow rod.

10. The process according to claim 7, wherein the hollow shear tool includes a base segment, a ring segment and a breakaway segment.

11. The system according to claim 7, wherein a perforated nipple is attached to the hollow shear tool.

* * * * *